US005814927A

United States Patent [19]

Chen

[11] Patent Number: 5,814,927

[45] Date of Patent: Sep. 29, 1998

[54] SOCKET FOR AUTOMOTIVE DISCHARGE LAMPS

[75] Inventor: Ping Chen, Nagoya, Japan

[73] Assignee: The Whitaker Corporation, Wilmington, Del.

[21] Appl. No.: 842,452

[22] Filed: Apr. 24, 1997

[30] Foreign Application Priority Data

May 30, 1996 [JP] Japan ..... 8-206681

[51] Int. Cl.[6] ..... H01R 33/00

[52] U.S. Cl. ..... 313/318.03; 313/318.01; 313/51; 362/226; 439/613; 439/230; 439/602

[58] Field of Search ..... 313/318.03, 318.09, 313/51, 318.01, 318.08, 318.1, 49, 318.11, 318.12, 318.07; 439/613, 230, 602, 612, 614; 362/389, 226, 296

[56] References Cited

U.S. PATENT DOCUMENTS 1,824,804 9/1931 Douglas ..... 362/296
4,868,456 9/1989 Sanders et al. ..... 313/318.05
5,216,318 6/1993 Van Dulmen et al. ..... 313/51
5,378,958 1/1995 van Heeswijk ..... 313/318.03
5,418,698 5/1995 Wu ..... 362/389
5,659,221 8/1997 Coushaine et al. ..... 313/318.01
5,709,450 1/1998 Francis et al. ..... 313/318.01

*Primary Examiner*—Sandra L. O'Shea
*Assistant Examiner*—Michael Day
*Attorney, Agent, or Firm*—Bradley N. Ditty

[57] ABSTRACT

In a socket for discharge lamps 10, having a tubular enclosure 22, a female terminal 23 is located in the center of the socket. A circular elastic sleeve 24 is mounted to the outside surface of the tubular enclosure. On the inside surface of the elastic sleeve 24, grooves 31 are formed fitting over the ribs 30 made on the outside surface of the tubular enclosure 22. A number of steps extending in a circumferential direction are formed on the surface 51, which comes in contact with the discharge lamp 100. The discharge lamp 100 can be easily removed for the replacement while the elastic sleeve 24 remains attached to the socket 10. The elastic sleeve 24 makes it possible to secure tight sealing after the discharge lamp has been replaced.

19 Claims, 3 Drawing Sheets

SOCKET FOR AUTOMOTIVE DISCHARGE LAMPS

BACKGROUND OF THE INVENTION

1. Field of the Invention

The discharge lamp socket according to this invention relates to sockets for high-intensity discharge lamps for automotive headlights.

2. Description of the Prior Art

Recently, attempts are being made to use high-intensity discharge lamps (HID lamps) operating on the principle of gaseous discharge for automotive headlights. High-intensity discharge lamps produce light by passing high-voltage (over 20 kV) current through a pair of electrodes placed in a sealed glass tube filled with xenon or other inert gas (for the discharge firing), mercury vapor or metal halides. Their output is a high intensity light which is close to natural light in color. Equipment related to automotive high-intensity discharge lamps is described in Japanese Utility Model Disclosures Nos. Hei 5 (1994)-68088 and Hei 6 (1995)-17173.

However, in designing of sockets for high-intensity discharge lamps of this type, special considerations must be given to insulation properties between electrodes. As it was mentioned above, the firing voltage of discharge in these lamps is in excess of 20 kV. When the high-intensity discharge lamp is in the socket, there is a danger that a discharge can occur in the air gap between these two discharge lamp electrodes which can result in a failure to start discharge inside the tube or in a damage to the socket.

Therefore, it is necessary to eliminate the above mentioned gap between the lamp electrodes by arranging the electrodes of the high-intensity discharge lamp or corresponding terminals of the socket so that they are tightly sealed.

However, these discharge lamps from time to time must be replaced because of malfunctions, degradation of color spectrum, reduced brightness or as part of a regular maintenance procedure. Therefore, it is desirable to have said tight seal of such a design that it would be possible to make replacements of the lamps.

SUMMARY OF THE INVENTION

This invention pertains to a socket in which discharge lamps having a round base are inserted. The lamps consist of an insulating housing with an axially positioned conical cavity of a smaller diameter formed in it. A first post-type electrode is located in the center of said cavity and a second electrode is positioned on the outside circumference of the lamp insulating body. The socket is characterized by the fact that it has a centrally positioned female electrode intended for the engagement with said first lamp electrode, a tubular enclosure surrounding said female electrode, and a ring-shaped elastic sleeve tightly fitting over the outside surface of said tubular enclosure. The outer surface of the ring-shaped elastic sleeve comes into contact with the inside surface of the above mentioned cavity of said discharge lamp. Furthermore, on the surface of said ring-shaped elastic sleeve that comes into contact with the inside surface of the lamp cavity, several steps are formed in a rotationally symmetrical pattern. Retention means are provided on the inside surface of the sleeve coming in contact with the tubular enclosure sleeve.

It is desirable for the elastic component to have a congruent configuration with the discharge lamp cavity. The steps coming in contact with the surface of the cavity can have a sawtooth shaped cross section.

It is preferable that the above mentioned retention device is configured either as a concavo-convex engagement, as a unit with sawtooth shaped ribs facing tubular surface or as a combination of these two options. If the option with sawtooth shaped ribs is selected, it is preferable that sawtoothed ribs have a surface perpendicular to the tubular surface facing in the direction of said discharge lamp.

In the socket for discharge lamps according to this invention, the round elastic sleeve is affixed to the outside surface of the tubular enclosure surrounding one electrode in such a manner that it can not be easily removed. On the surface of the sleeve which comes in contact with the discharge lamp, steps are formed to facilitate the removal of the discharge lamp during its replacement without dislodging the elastic sleeve. This design has an outstanding safety due to the fact that eliminates air pockets inside the socket after the replacement of the discharge lamp, thus preventing the possibility of discharge inside the socket.

DETAILED DESCRIPTION OF THE PREFERRED EMBODIMENTS

Below, we give detailed explanations concerning the preferred embodiment of the socket for discharge lamps according to this invention with reference to the attached drawings.

Figure 1:
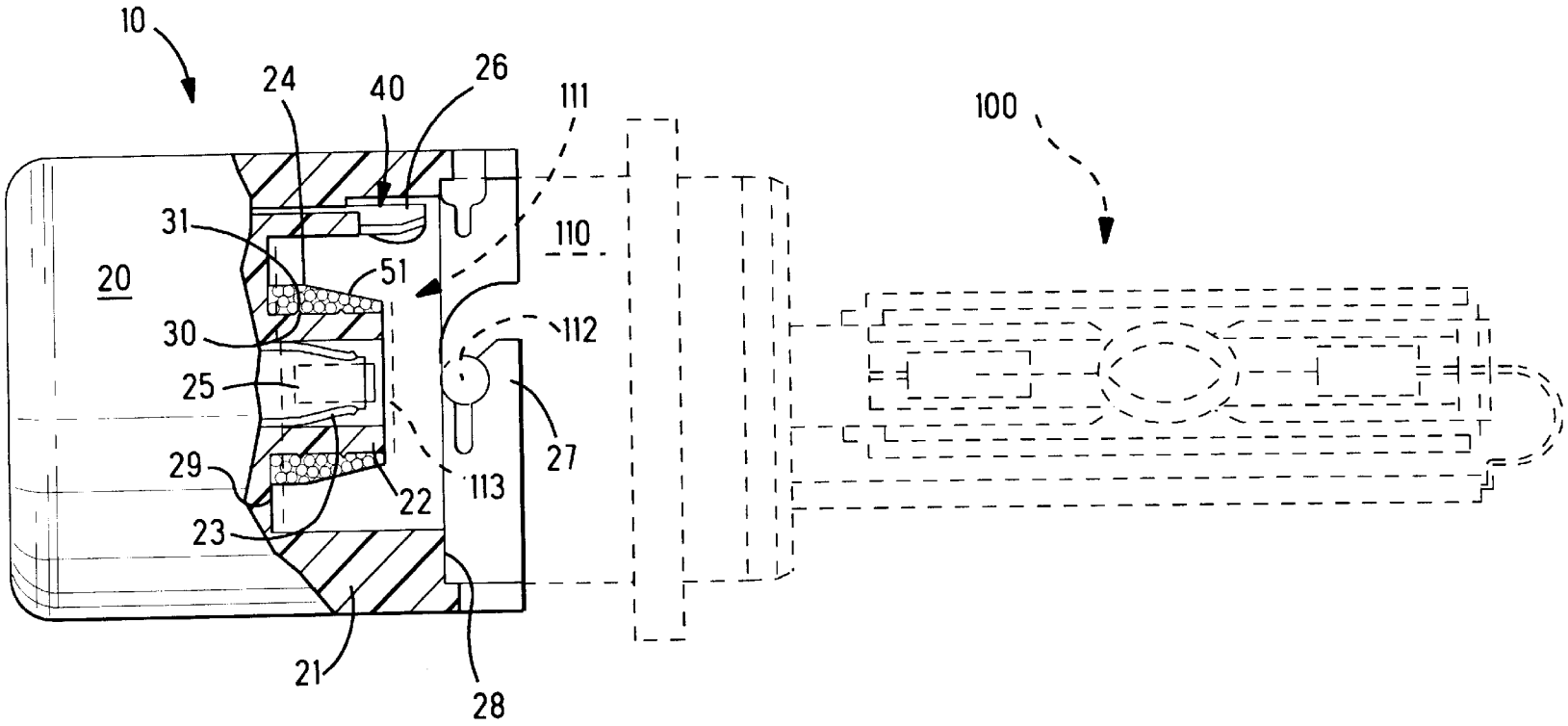
FIG. 1 is a partially cross sectioned view of the preferred embodiment of the socket for discharge lamps according to this invention (the discharge lamp is shown by broken lines).
Figure 2:
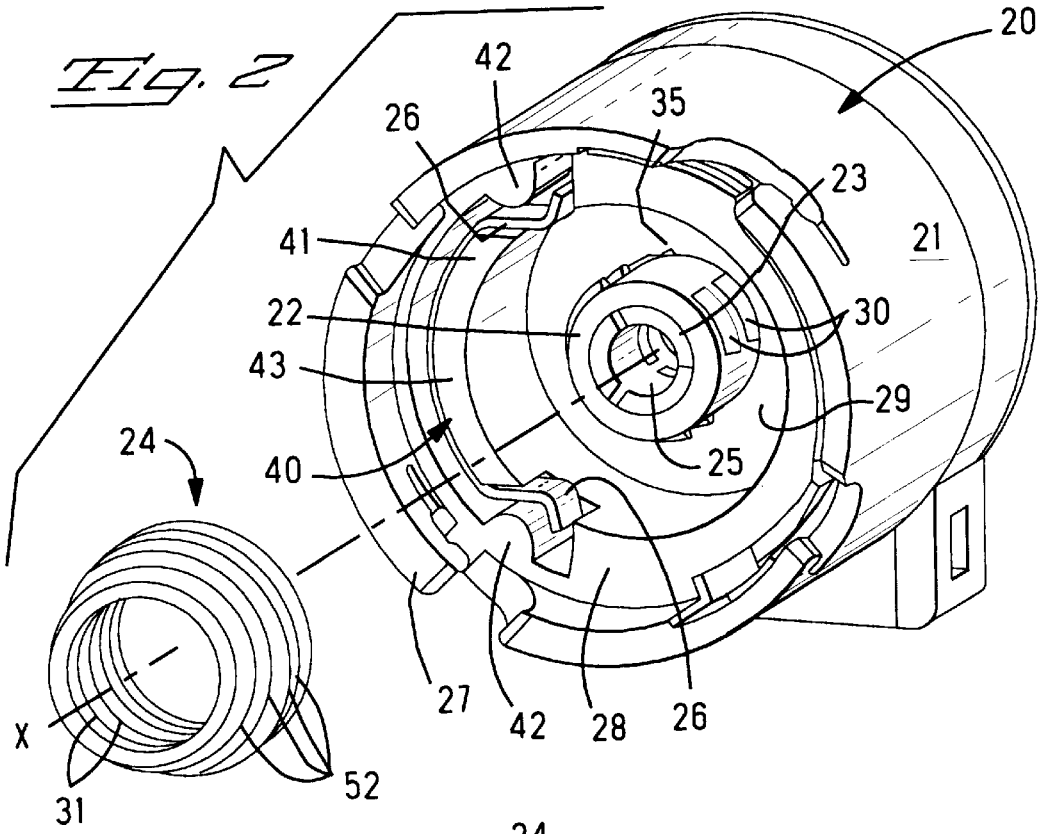
FIG. 2 is a three dimensional view of the socket for discharge lamps shown in FIG. 1 before the mounting of the elastic sleeve.
Figure 3:
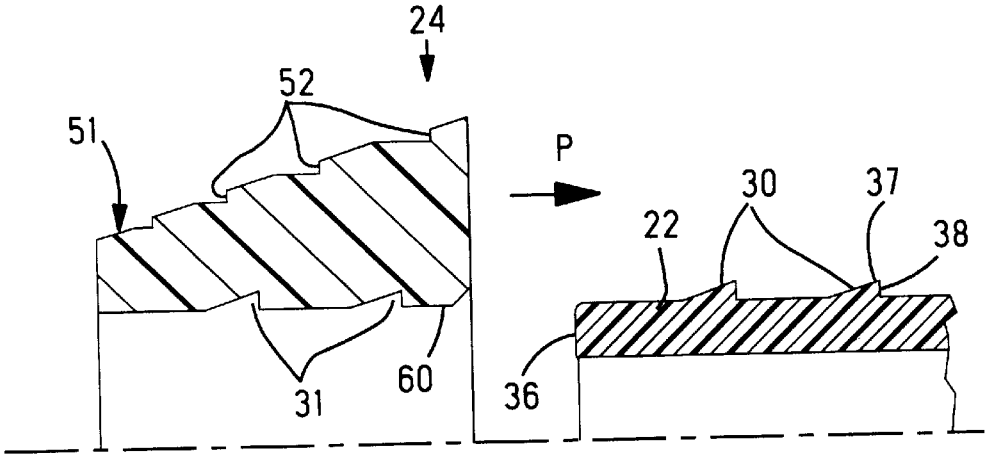
FIG. 3 is an enlarged cross sectional view of a portion of the elastic sleeve prior to mounting.
Figure 4:
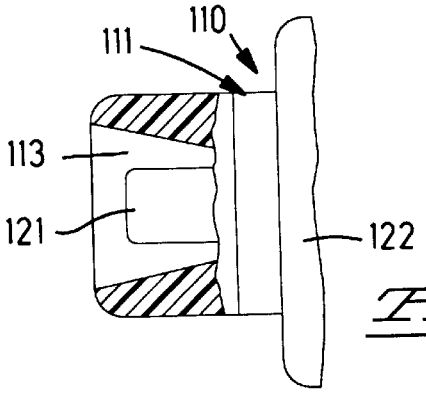
FIG. 4 is a partially cross sectioned view of the base of the discharge lamp which is inserted in the socket.

FIGS. 1 through 3 represent a preferred embodiment of this invention. FIG. 1 is a partially sectioned view of the socket for discharge lamps (below, simply "socket") with the discharge lamp shown by broken line. FIG. 2 is an oblique view of the socket shown in FIG. 1; and FIG. 3 is an enlarged cross section of a portion of the elastic component before the assembly. For reference, a side view with a broken-off section of the base of the discharge lamp intended for the insertion in the socket is shown in FIG. 4. In FIG. 1, the leaf terminal 26, to be subsequently described in more detail, is shown, for simplicity, in a position different from the original position.

As shown in FIG. 1, base 110 of the discharge lamp 100 is inserted in the socket 10. As shown in FIG. 4, the base 110 is made in the form of a round post of relatively small diameter with an insulating stem 111 extending in the direction of the contact. At the end of the insulating stem 111, a conical cavity 113 is made of a smaller diameter. As can be seen from FIG. 4, in the center of the cavity 113, a post shaped first electrode 121 is located, and a second electrode 122 is positioned on the outer surface of the insulating stem 111. Base 110 also has lugs 112 shown by broken lines in FIG. 1. Lugs 112 fit into indexing slots 27 made at the edge of the socket 10, and when the discharge lamp 100 is fully inserted into the socket, a portion of the lamp base comes against the step 28.

According to FIGS. 1 and 2, when the cavity 113 of the insulating stem 111 engages the socket 10, the first electrode 121 comes in contact with female terminal 23 arranged in the terminal holding recess 25 located in the center of the socket 10. The female terminal 23 is surrounded by a tubular enclosure 22. On the outer surface of this tubular enclosure 22, a circular elastic sleeve 24 made of silicone rubber or a similar material is tightly fitted. As can be seen from the drawings, the elastic sleeve 24 covers the entire outside surface of the tubular enclosure 22. When the discharge lamp is inserted, the elastic sleeve 24 forms a tight seal between the inside surface of the cavity 113 and the tubular enclosure 22.

FIG. 3 is a cross section showing the elastic sleeve 24 before assembly. In order to better explain the process of assembly, a portion of the tubular enclosure 22 is also shown in FIG. 3. On the inner surface 60 of the elastic sleeve 24, matching cavities 31 are formed. When the elastic sleeve 24 is fitted over the outer surface of the tubular enclosure 22, matching cavities 31 engage matching ribs 30, having a triangular cross section, on the outer surface of the tubular enclosure 22. The sleeve is pulled over the enclosure in the direction shown by arrow P. The sides 37 of the matching ribs 30 facing the front end of the tubular enclosure 22 are inclined. The opposite sides 38 are perpendicular to the outer surface of the enclosure. Since the cavities 31 and ribs 30 have complementary configurations, the elastic sleeve 24 can not be easily removed when it is pulled in the direction opposite to that shown by arrow P. On the curved surface 51 of the elastic sleeve, which comes in contact with the inside surface of the lamp cavity 113, a number of steps 52 are along the entire circumference of the sleeve. Steps 52 are made in the form of sawtooth facing the discharge lamp 100. When the sleeve comes in contact with the inside surface of the cavity 113, steps 52 become deformed, thus providing for a tight sealing. Thanks to these steps 52, when there is a need to take the discharge lamp 100 from the socket 10, the inside surface of the cavity 113 of the discharge lamp 100 can be easily separated from the surface 51 of the elastic sleeve 24, due to air pockets formed by the steps 52.

As can be seen from FIG. 2, matching ribs 30 are grouped in three clusters along the circumference. As can be understood by referring to FIG. 1 and FIG. 2, the socket is fabricated using a first mold which is applied in the same direction as the direction of the insertion of the discharge lamp 100, and a second mold which can rotate relative to the first mold. This makes it possible to remove the second mold used for making matching ribs 30 by moving it in the space 35 between the matching ribs 30, thus permitting removal of the socket from the second and the first. It is preferable to have the space 35 between the matching ribs 30 in the direction of circumference longer than the length of said ribs. This design makes it possible to provide a better sealing due to the fact that there is no necessity to provide an opening in the bottom 29 of the socket for the removal of the mold or for forming ribs 30, thus providing a superior protection against discharge through air. This design is also superior from the standpoint of water proof characteristics.

As can be seen from FIG. 2, the above mentioned step 28 is formed on the inside of the outer wall 21 of the housing 20 of the socket 10. A portion of this step 28 is cut out to form a cavity 41 accommodating the leaf terminal 40 intended for the connection with the second electrode 122 of the discharge lamp 100. The leaf terminal 40 consists of a base (not shown in the drawing) extending inside the socket and a pair of cantilevered arms 43 attached thereto. The ends of arms 43 are bent to a roughly U-shaped configuration to form contact sections 26.

As shown in FIG. 2, arms 43 of the leaf terminal 40 are accommodated inside the cavity 41 along circumference of the socket. At the ends of the cavity 41, semi-circular posts 42 are formed. These posts 42 serve as rests for the back side of the contacting sections 26 and provide anti overstress for arms 43. The contacting sections 26 of the leaf terminal 40 occupy an arc of more than 90 degrees of the housing 20 when looking along its axis X. Therefore, the deviation of the discharge lamp due to reaction from the leaf terminal 40 is practically negligible. In order to facilitate the insertion of the discharge lamp in the socket, the contacting sections 26 are inclined as shown in FIG. 1.

Figure 5:
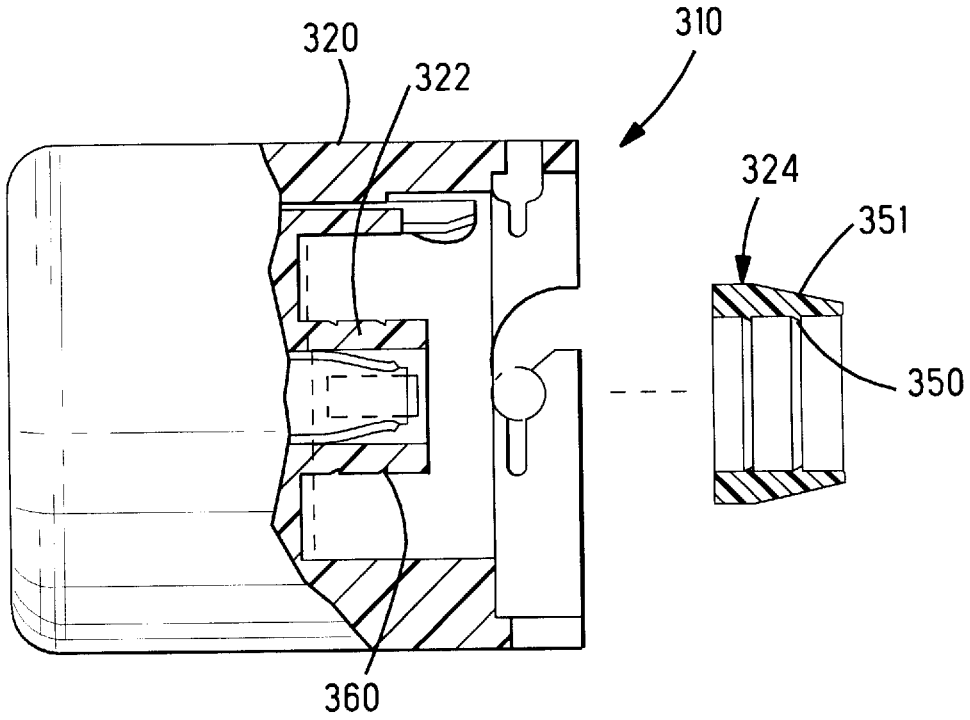
FIG. 5 is a partially cross sectioned view of another preferred embodiment of the socket for discharge lamps.
Figure 6:
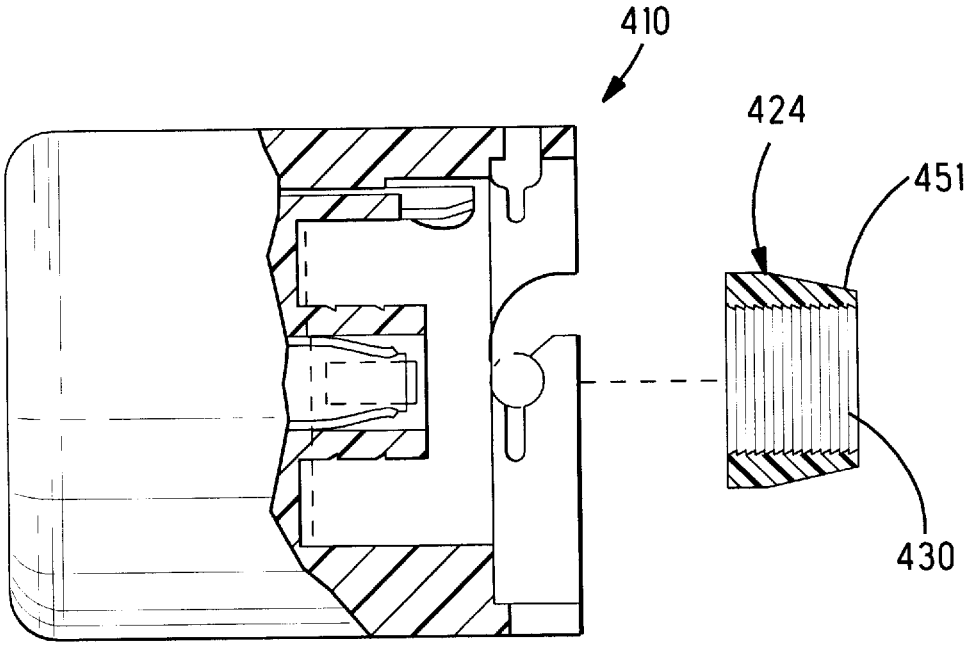
FIG. 6 is a partially cross sectioned view of one more preferred embodiment of the socket for discharge lamps.

FIGS. 5 and 6 depict partial cross sections of two other embodiments of the invention: sockets 310, 410. In FIGS. 5 and 6, elastic sleeves 324, 424 are shown in removed status. Configuration of elastic sleeves 324 and 424 of sockets 310 and 410 is similar to that of socket 10 for the purpose of prevention of their sliding off the tubular enclosures 322 and 422.

Ribs 350 are formed on the interior surface of the elastic sleeve 324, and the outside surface of the tubular enclosure 322 has grooves 360 which are complementary in shape to the ribs 350. The engagement of these grooves 360 and ribs 350 provides for a positive attachment of the elastic sleeve 324.

In the embodiment represented in FIG. 6, the elastic sleeve 424 has on its inside surface multiple ribs 430 of a sawtoothed cross section. It is preferable that surfaces of these ribs 430 facing the discharge lamp were perpendicular to the outside surface of the tubular enclosure 422. The elastic sleeve 424 is retained on the tubular enclosure by means of interference fit. In this design, the elastic sleeve 424 can not be easily removed from the tubular enclosure even when an external force is applied to it. This design can be used along with designs depicted in FIGS. 1 or 5. For the sake of simplicity, the surfaces 351 and 451 of the elastic sleeves 324 and 424 coming in contact with the cavity 113 of the discharge lamp 100 appear in FIGS. 5 and 6 as smooth surfaces, but in fact they have steps facilitating the removal of the discharge lamp.

The above explanations are concerned with several preferred embodiments of the socket for discharge lamps according to this invention, but the invention is not limited to said embodiments only and various modifications can be introduced by experts.

I claim:

1. A socket for discharge lamps having a round base intended for the insertion in said socket in which the base of the discharge lamp includes an insulating housing with an axially positioned conical cavity; a first post-type electrode located in the center of said cavity; and a second electrode arranged on the outside circumference of said insulating housing;

the socket being characterized by the fact that the socket has a centrally positioned female electrode intended for the engagement with said first electrode; a tubular enclosure surrounding said female electrode; and a ring-shaped elastic sleeve tightly fitting on the outside surface of said tubular enclosure, the elastic sleeve outer surface contacting the inside surface of the above mentioned cavity of said discharge lamp;

and by the fact that on the surface of said ring-shaped elastic sleeve, contacting the inside surface of said cavity, several steps are formed in a rotationally symmetrical pattern; and retention means are provided on the inside surface of the sleeve coming in contact with the tubular enclosure sleeve.

2. The socket of claim 1 wherein the elastic sleeve comprises a conical member with the outside surface of the conical member conformable to the discharge lamp conical cavity.

3. The socket of claim 2 wherein the tubular enclosure comprises a right circular cylinder.

4. The socket of claim 3 wherein the inside surface of the elastic sleeve conforms to the surface of the cylindrical tubular enclosure and the outside surface of the elastic sleeve is inclined relative to the tubular enclosure to conform to the discharge lamp tubular enclosure.

5. The socket of claim 1 wherein ribs are formed on the tubular enclosure and said retention means on the elastic sleeve comprise cavities engagable with said ribs.

6. The socket of claim 1 wherein the said steps on the exterior of the elastic sleeve are deformable and contact the discharge lamp conical cavity to form a seal.

7. The socket of claim 6 wherein the engagement between the elastic sleeve and the discharge lamp conical surface is relatively more releasable than the retention between the elastic sleeve and the tubular enclosure so that the discharge lamp can be removed from the socket without removal of the elastic sleeve.

8. The socket of claim 1 wherein a plurality of circumferentially spaced ribs are formed on the exterior of the tubular enclosure, the elastic sleeve retention means being engagable with the ribs.

9. The socket of claim 8 wherein adjacent ribs on the tubular enclosure are spaced apart by a gap having a greater circumferential dimension than the circumferential dimension of individual ribs.

10. The socket of claim 9 wherein the socket has a solid bottom surface without openings therein.

11. A socket for use with a discharge lamp: the socket comprising a molded insulating housing and first and second electrodes engagable with a discharge lamp positioned in the socket; the housing having a bottom wall with a tubular enclosure extending upwardly from the bottom wall with the first electrode being positioned within the tubular enclosure; the insulating housing also including retention ribs on the exterior of the tubular enclosure, with the bottom wall being continuous beneath the ribs so that no opening for discharge through air is located adjacent to the tubular enclosure, the socket also including an elastic sleeve positioned on the tubular enclosure to form a seal between the tubular enclosure and a discharge lamp positioned in the socket.

12. The socket of claim 11 wherein individual retention ribs are separated by a circumferential gap.

13. The socket of claim 12 wherein the gaps between adjacent ribs have a circumferential dimension that is greater than the circumferential dimension of the individual retention ribs.

14. The socket of claim 13 wherein the relative circumferential dimension of each gap is sufficient to permit withdrawal of a portion of a mold initially forming a corresponding retention rib adjacent to the gap after the portion of the mold forming the corresponding rib is rotated into alignment with the gap.

15. The socket of claim 12 wherein multiple retention ribs are molded along the axis of the tubular enclosure with ribs being molded in clusters separated by gaps.

16. The socket of claim 11 wherein each retention rib includes a perpendicular surface facing the bottom wall and an inclined surface facing away from the bottom wall so that the elastic sleeve can slide into position onto the tubular enclosure, but the perpendicular surface engages the elastic sleeve to prevent removal of the elastic sleeve from the tubular enclosure.

17. The socket of claim 16 wherein the elastic sleeve includes deformable steps on the exterior surface for forming a seal when in engagement with a discharge lamp positioned in the socket.

18. The socket of claim 17 the deformable steps form air pockets when deformed to reduce the disengagement force between the discharge lamp and the socket.

19. The socket of claim 18 wherein the deformable steps are located on an conical surface of the elastic sleeve.

* * * * *